US006986387B2

(12) United States Patent
Hancock

(10) Patent No.: US 6,986,387 B2
(45) Date of Patent: Jan. 17, 2006

(54) MULTI-MODE DAMPER FOR AN A-SHAPED HEAT EXCHANGER

(75) Inventor: Stephen S. Hancock, Flint, TX (US)

(73) Assignee: American Standard International Inc., New York, NY (US)

( * ) Notice: Subject to any disclaimer, the term of this patent is extended or adjusted under 35 U.S.C. 154(b) by 202 days.

(21) Appl. No.: 10/424,647

(22) Filed: Apr. 25, 2003

(65) Prior Publication Data

US 2004/0211553 A1 Oct. 28, 2004

(51) Int. Cl.
*F25B 29/00* (2006.01)

(52) U.S. Cl. ..... 165/260; 165/97; 165/103

(58) Field of Classification Search ..... 165/260, 165/96, 97, 101, 240, 241, 296, 299, 103, 165/48.1, 54, 58, 59, 61, 64, 65; 62/186
See application file for complete search history.

(56) References Cited

U.S. PATENT DOCUMENTS 2,205,117 A * 6/1940 Chambers ..... 62/186
3,308,805 A * 3/1967 Stockli ..... 165/64
3,332,475 A 7/1967 Selhost et al.
5,533,357 A * 7/1996 Voorhis ..... 62/277
5,816,066 A 10/1998 Aoki et al.
6,739,388 B2 * 5/2004 Nakagawa et al. ..... 165/202

FOREIGN PATENT DOCUMENTS

JP 60-255522 * 12/1985
JP 6-40238 * 2/1994

* cited by examiner

*Primary Examiner*—Teresa J. Walberg
(74) *Attorney, Agent, or Firm*—William J. Beres; William O'Driscoll

(57) ABSTRACT

A temperature conditioning system includes a damper system that determines the pattern of airflow through two coil slabs of an indoor heat exchanger, wherein the heat exchanger is preferably part of a split-system air conditioner or a heat pump. In a normal mode position, the damper system directs the airflow in a parallel flow relationship through the two coil slabs for optimum capacity and efficiency. In an enhanced mode position, the damper system directs the airflow in a series flow relationship through the two coil slabs. The enhanced mode position not only helps reduce humidity when the temperature conditioning system operates in a cooling mode but also helps raise the supply air temperature at a room register when the system is operating in a heating mode. In some embodiments, the damper system is also movable to a bypass position that allows the air to bypass the indoor heat exchanger.

33 Claims, 4 Drawing Sheets

MULTI-MODE DAMPER FOR AN A-SHAPED HEAT EXCHANGER

BACKGROUND OF THE INVENTION

1. Field of the Invention

The present invention relates to an HVAC system (heating, ventilating, air-conditioning system) that includes a refrigerant circuit with an indoor coil having two coil slabs; the invention more specifically relates to a damper apparatus for determining whether airflow travels through the two coil slabs in parallel or series.

2. Description of Related Art

Typical split-system air conditioners and heat pumps comprise a refrigerant circuit with an indoor and an outdoor heat exchanger. Depending on the refrigerant's direction of flow through the circuit, the indoor heat exchanger may cool or heat a current of air, which is then conveyed to a comfort zone, such as room or other area within a building.

The indoor heat exchanger may comprise two sections, called coil slabs, which are often arranged in an A-shape. To heat or cool the air, a blower forces the air in parallel flow relationship across the two coil slabs. Such an airflow pattern provides several advantages, such as optimum system efficiency, maximum heating or cooling capacity, and plenty of airflow. In some applications, however, such a system has its drawbacks.

Many HVAC systems, for instance, exchange a considerable amount of indoor air with outside air to help keep the indoor air fresh. Unfortunately, the outdoor air may be humid, which can create a dank feeling within the building. The HVAC system, therefore, may require some means for reducing the humidity.

Another problem may exist with heat pumps operating in a heating mode. Although the heat pump may have sufficient capacity to maintain the building at a desired temperature, the heated air that a register discharges into a comfort zone may feel uncomfortably cool or drafty. This can be due to the supply air temperature being warmer than the room temperature but cooler than a person's body temperature. Consequently, the supply air temperature may need to be raised.

A further problem concerns systems that may operate the system blower with the refrigeration system de-activated. Examples of this would be for air circulation or when the refrigeration system is utilized with a combustion furnace. Here the resistance to airflow by the indoor heat exchanger becomes an undesirable system efficiency loss.

SUMMARY OF THE INVENTION

To overcome the limitations of current split-system air conditioners and heat pumps, it is an object of the invention to provide a damper system that determines whether the airflow though two coil slabs of an indoor heat exchanger passes through the coil slabs in a parallel or series flow relationship.

Another object of some embodiments is to provide a damper system with an enhanced mode position that helps a heating system raise the temperature of air being supplied to a comfort zone.

Another object of some embodiments is to provide a damper system with an enhanced mode position that helps a cooling system lower the temperature of air being supplied to a comfort zone.

Another object of some embodiments is to provide a damper system with an enhanced mode position that helps a cooling system lower the humidity of air being supplied to a comfort zone.

Another object of some embodiments is to provide a damper system with an enhanced mode position that helps reduce the airflow to a comfort zone by increasing the airflow resistance of an indoor heat exchanger.

Another object of some embodiments is to provide a damper system that is selectively movable to a normal mode position, an enhanced mode position and a bypass position.

Another object of some embodiments is to provide a damper system that upon switching from a normal mode position to an enhanced mode position reverses the direction of airflow through one coil slab of a dual-slab indoor heat exchanger.

Another object of some embodiments is provide a temperature conditioning system with a burner, a refrigerant heat exchanger, and a damper system, wherein the damper system is movable to a bypass position to allow furnace-heated air to bypass the refrigerant heat exchanger when the refrigerant heat exchanger is inactive.

Another object of some embodiments, is to provide an A-shaped indoor heat exchanger that operates in conjunction with a damper system, wherein refrigerant flows in a parallel flow relationship through two coil slabs of the indoor heat exchanger.

One or more of these and/or other objects of the invention are provided by a temperature conditioning system that includes a damper system that determines the pattern of airflow through two coil slabs of an indoor heat exchanger. In a normal mode position, the damper system directs the airflow in a parallel flow relationship through the two coil slabs. In an enhanced mode position, the damper system directs the airflow in a series flow relationship through the two coil slabs.

DESCRIPTION OF THE PREFERRED EMBODIMENT

Figure 2:
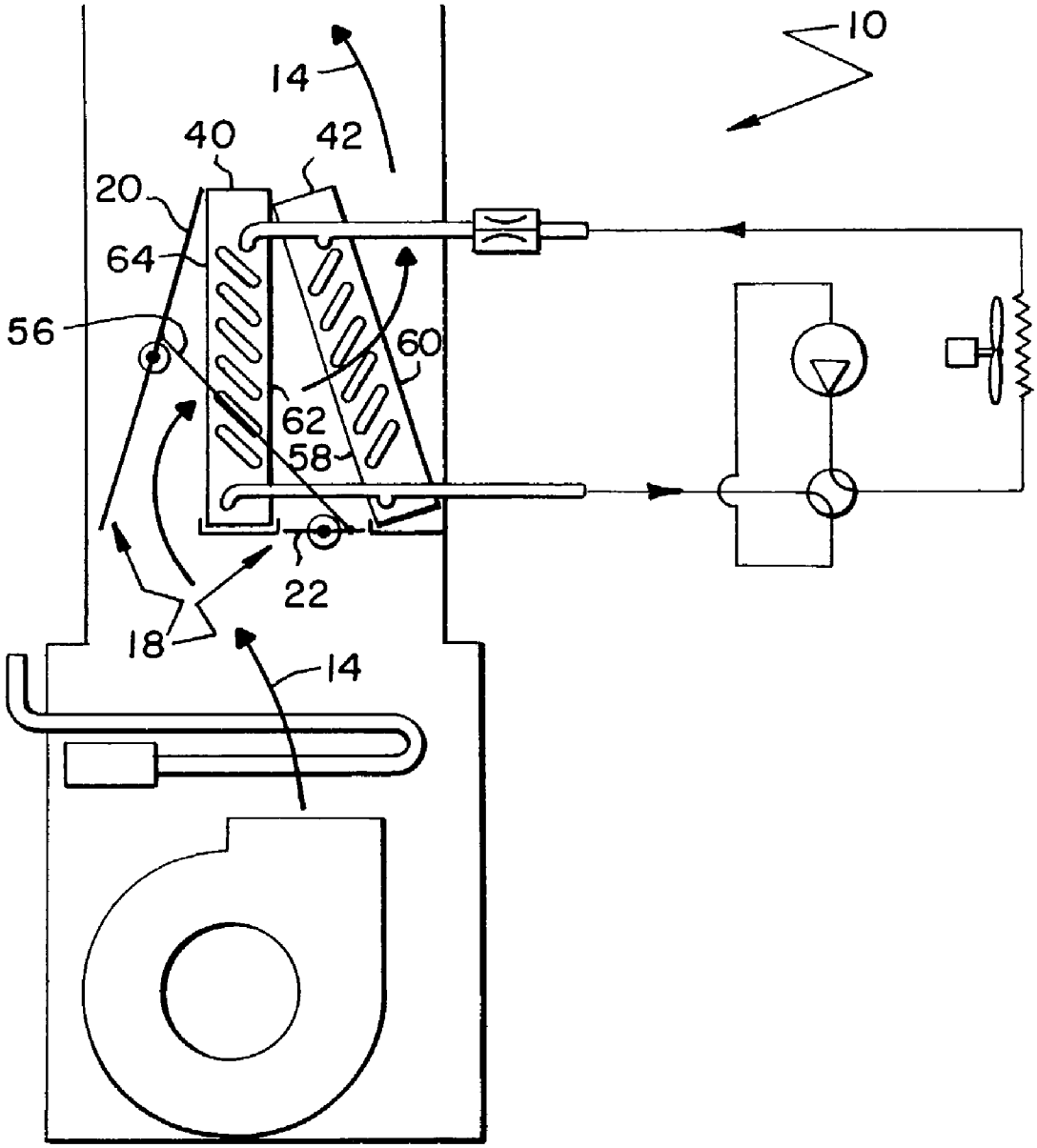
FIG. 2 is similar to FIG. 1 but showing the temperature conditioning system operating in a cooling mode with the damper system in an enhanced mode position.
Figure 3:
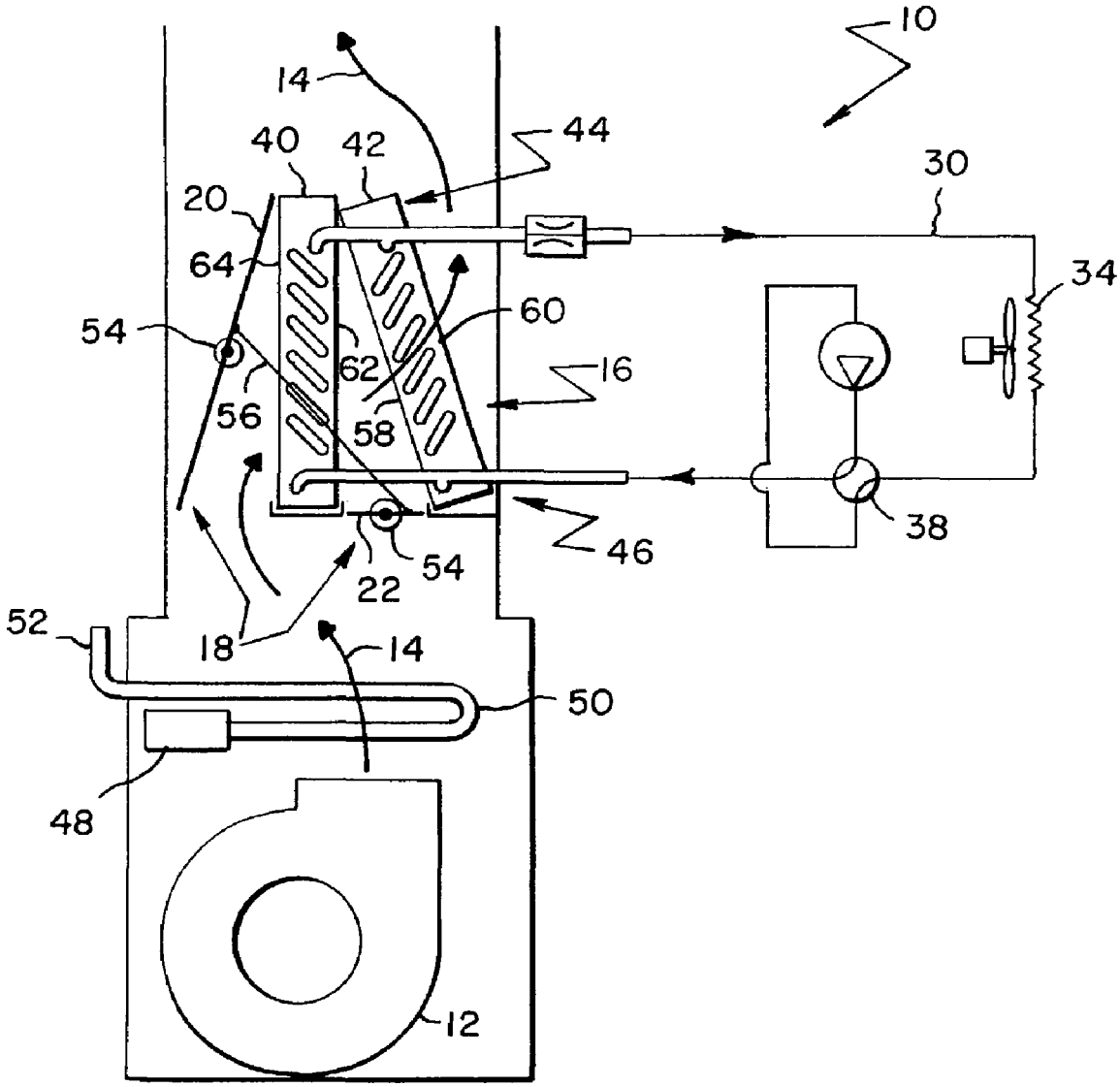
FIG. 3 is similar to FIG. 1 but showing the temperature conditioning system operating in a heating mode with the damper system in the enhanced mode position.
Figure 4:
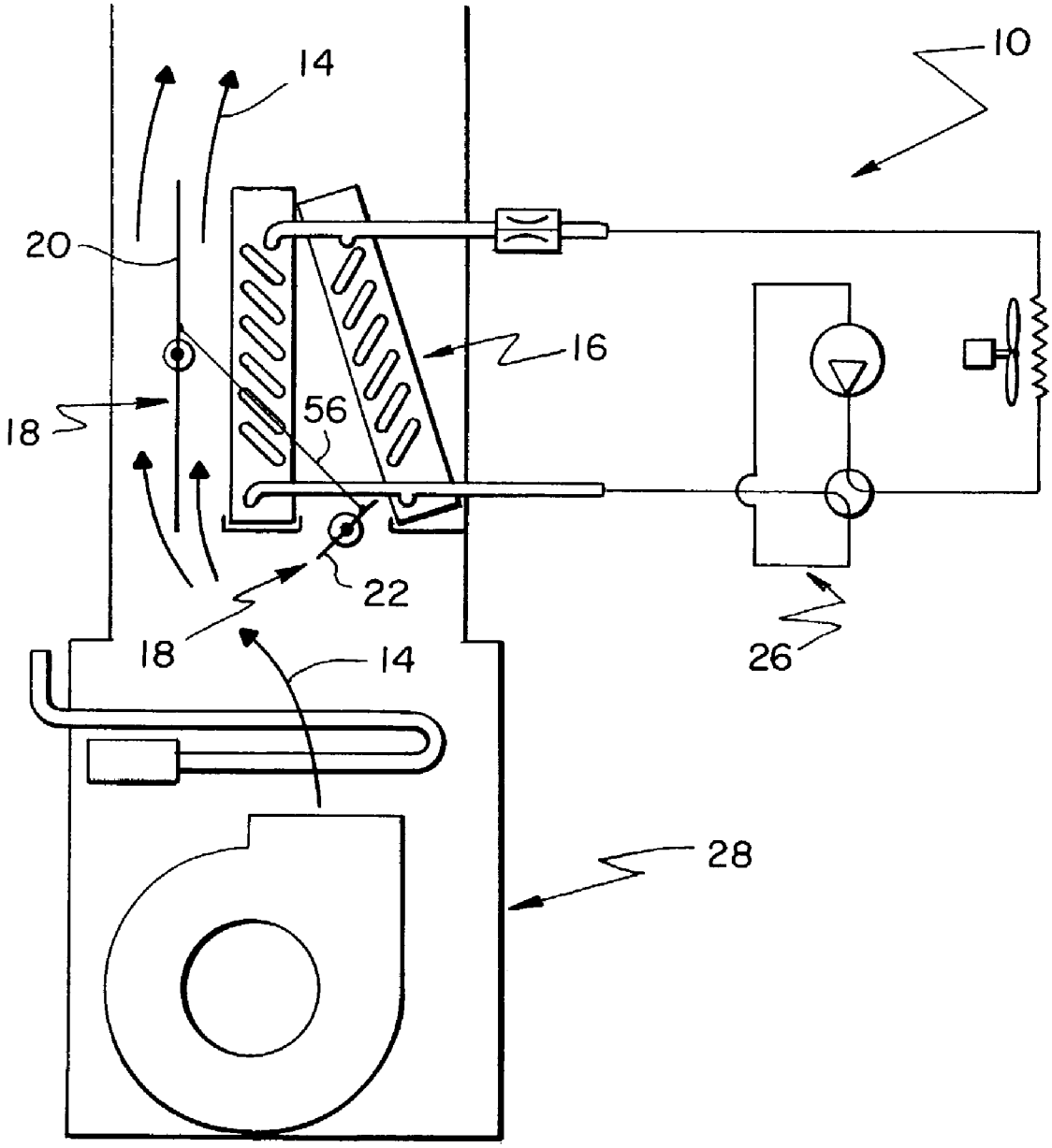
FIG. 4 is similar to FIG. 1 but showing the damper system in a bypass position.

A temperature conditioning system 10, shown in FIGS. 1–4, includes a blower 12 that can force air 14 across a heat exchanger 16 to heat, cool, and/or dehumidify the air. A damper system 18, comprising dampers 20 and 22, determines the air's flow path through or around heat exchanger 16, thereby determining whether system 10 operates in a normal mode (FIG. 1), an enhanced mode (FIGS. 2 and 3) or a bypass mode (FIG. 4). After air 14 travels past heat exchanger 16, a supply air duct 24 can convey the air to a comfort zone, such as a room or other area within a building. To circulate air 14 between system 10 and the comfort zone, a conventional return air duct can convey air 14 from the comfort zone back to system 10. Examples of system 10 include but are not limited to an air conditioner, a heat pump, a furnace, and various combinations thereof. For illustration, system 10 will be described with reference to a heat pump 26 associated with a furnace 28.

Figure 1:
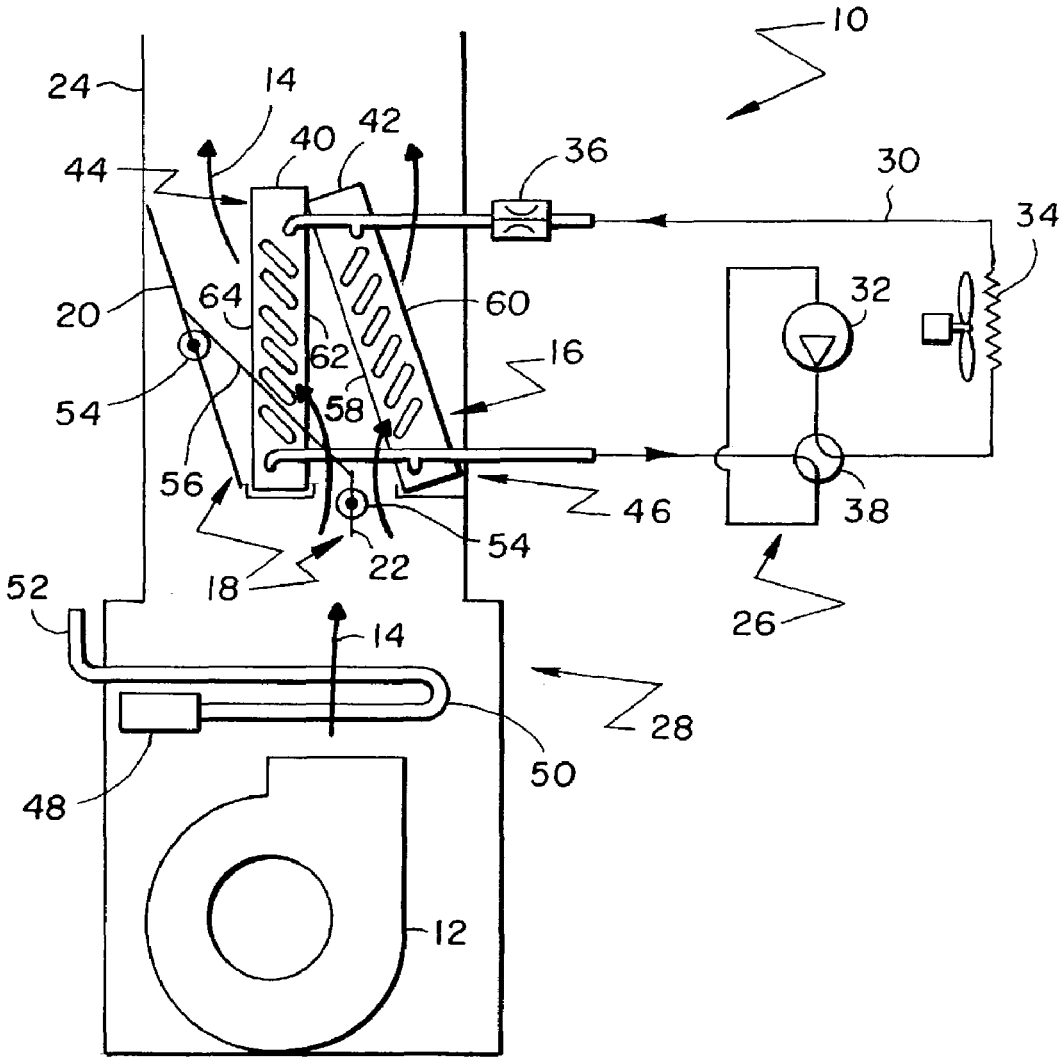
FIG. 1 is a schematic view of a temperature conditioning system operating in a cooling mode with a damper system in a normal mode position.

Heat pump 26 includes a refrigerant circuit 30 that interconnects a refrigerant compressor 32; an outdoor heat exchanger 34; an indoor heat exchanger, such as heat exchanger 16; and an expansion device 36, such as a conventional expansion valve, orifice, capillary, etc. When operating in a cooling mode, as shown in FIGS. 1 and 2, heat exchanger 16 functions as an evaporator to cool air 14, and outdoor heat exchanger 34 functions as a condenser to expel waste heat.

In a heating mode, as shown in FIG. 3, a valve 38 can be used to reverse the direction of refrigerant flow through much of circuit 30. The reversed flow direction reverses the roles of heat exchangers 16 and 34; that is, heat exchanger 16 becomes a condenser that heats air 14, and heat exchanger 34 becomes an evaporator that absorbs outdoor heat.

Heat exchanger 16 comprises two tube and fin heat exchangers that are referred to as coil slabs 40 and 42. Heat exchanger 16 is generally A-shaped in that coil slabs 40 and 42 are closer to each other at an upper portion 44 than at a lower portion 46 of heat exchanger 16. Refrigerant in circuit 30 preferably travels in a parallel flow relationship through slabs 40 and 42.

For additional heat, or for refrigerant circuits designed for cooling only, system 10 may include a furnace burner 48 with a clamshell heat exchanger 50 and a flue gas exhaust pipe 52. Burner 48 and heat exchanger 50 can be installed beneath heat exchanger 16. In this way, blower 12 forces air 14 across the furnace's heat exchanger 50 before the air passes through or around the upper heat exchanger 16.

Regardless of whether system 10 operates in a cooling mode (FIGS. 1 and 2) or a heating mode (FIG. 3), the positioning of damper system 18 determines whether system 10 further operates in a normal mode (FIG. 1), enhanced mode (FIGS. 2 and 3), or bypass mode (FIG. 4). Separate actuators 54 can individually control the movement of dampers 20 and 22. Alternatively, a single actuator 54 can be mechanically coupled to move both dampers, wherein a mechanical linkage 56 coordinates the movement of the two dampers. Linkage 56 is schematically illustrated, for such a linkage can assume a variety of configurations that are well known to those skilled in the art. Actuator 54 can be any device capable of moving a damper. Examples of actuator 54 include, but are not limited to, an electric motor, a pneumatic cylinder, bellows, etc.

When damper system 18 is in its normal mode position and system 10 is operating in a cooling mode, as shown in FIG. 1, air 14 travels in parallel flow relationship through coil slabs 40 and 42. Some of the airflow travels from an upstream side 58 to a downstream side 60 of coil slab 42. And some airflow travels from a first side 62 to a second side 64 of coil slab 40.

When damper system 18 is in its enhanced mode position and system 10 is operating in a cooling mode, as shown in FIG. 2, air 14 travels sequentially or in series through coil slabs 40 and 42. In this case, dampers 20 and 22 direct substantially all or most of the airflow sequentially through second side 64, first side 62, upstream side 58 and downstream side 60.

The dampers' normal mode position and the enhanced mode position each have their own advantages when operating system 10 in the cooling mode. The normal mode position provides an airflow rate, system efficiency, and cooling capacity that is greater than that which can be achieved with damper system 10 in the enhanced mode position. The enhanced mode position, however, provides greater dehumidification. This is due to air 14 having to pass sequentially through coil slabs 40 and 42, which provide a greater airflow resistance than when air 14 is able to pass in parallel flow relationship through the coil slabs. For a given blower speed, greater airflow resistance reduces the airflow, which enables heat exchanger 16 to reduce the air temperature and humidity more than it could otherwise. In some embodiments, blower 12 operates at a substantially constant speed regardless of whether damper system 18 is at its normal mode position or enhanced mode position.

The dampers' normal mode position and the enhanced mode position each have their own advantages when operating system 10 in the heating mode as well. The normal mode position provides an airflow rate, system efficiency, and heating capacity that is greater than that which can be achieved with damper system 10 in the enhanced mode position. The enhanced mode position, as shown in FIG. 3, provides a greater supply air temperature, which can feel pleasantly warm near a register that feeds the air into the comfort zone. Again, this is due to air 14 having to pass sequentially through coil slabs 40 and 42, which provide a greater airflow resistance than when air 14 is able to pass in parallel flow relationship through the coil slabs. For a given blower speed, greater airflow resistance reduces the airflow, which enables heat exchanger 16 to raise the air temperature more than it could otherwise.

In some cases, system 10 may be operated with damper system 18 in its bypass position, as shown in FIG. 4. There may be a need, for instance, for circulated or filtered air 14 that is neither heated nor cooled. Or furnace 28 may need to operate with heat pump 26 deactivated. In either case, heat exchanger 16 serves no purpose, so the air preferably bypasses heat exchanger 16 to avoid unnecessary airflow resistance. Damper system 18, thus, moves to its bypass position of FIG. 4 to allow air 14 the freedom to blow past heat exchanger 16.

Although the invention is described with reference to a preferred embodiment, it should be appreciated by those skilled in the art that other variations are well within the scope of the invention. The shape of the indoor heat exchanger, for instance, can be other than an A-shape. The coil slabs can be arranged in a V-shape, the slabs can be offset and parallel to each other, or three or more slabs can be arranged in various other configurations. Moreover, the airflow does not necessarily have to reverse direction through either coil slab upon switching between the normal mode and enhanced mode. The scope of the invention, therefore, is to be determined by reference to the claims, which follow.

I claim:

1. A temperature conditioning apparatus, comprising:

a heat exchanger having a first coil slab adjacent to a second coil slab;

a blower forcing air through the first coil slab and the second coil slab; and a damper system adjacent to the heat exchanger and being selectively movable to a normal mode position and an enhanced mode position, wherein the air travels in parallel flow relationship through the first coil slab and the second coil slab when the damper system is in the normal mode position, and the air travels in series first through the first coil slab and next thru the second coil slab when the damper system is in the enhanced mode position;

wherein the first coil slab has a first side and a second side, wherein the air moves from the first side to the second side when the damper system is at the normal mode position, and the air moves from the second side to the first side when the damper system is at the enhanced mode position.

2. The temperature conditioning apparatus of claim 1, wherein the air moves at a greater flow rate when the damper system is in the normal mode position than when in the enhanced mode position.

3. The temperature conditioning apparatus of claim 2, wherein the blower operates at a substantially constant speed regardless of whether the damper system is at the normal mode position or the enhanced mode position.

4. The temperature conditioning apparatus of claim 1, wherein the second coil slab has an upstream side and a downstream side, wherein the air moves from the upstream side to the downstream side regardless of whether the damper system is at the normal mode position or the enhanced mode position.

5. The temperature conditioning apparatus of claim 1, wherein the damper system is further movable to a bypass position where the air is free to bypass both the first coil slab and the second coil slab.

6. The temperature conditioning apparatus of claim 1, wherein the heat exchanger provides greater airflow resistance when the damper system is at the enhanced mode position than when at the normal position.

7. The temperature conditioning apparatus of claim 1, wherein the first coil slab and the second coil slab are closer to each other at an upper portion of the heat exchanger than at a lower portion of the heat exchanger.

8. The temperature conditioning apparatus of claim 1, wherein the temperature conditioning apparatus is a heat pump, whereby the heat exchanger selectively heats and cools the air.

9. The temperature conditioning apparatus of claim 1, wherein the heat exchanger heats the air.

10. The temperature conditioning apparatus of claim 1, wherein the heat exchanger cools the air.

11. The temperature conditioning apparatus of claim 10, further comprising a burner disposed beneath the heat exchanger.

12. The temperature conditioning apparatus of claim 1, further comprising a refrigerant that flows in parallel flow relationship through the first coil slab and the second coil slab.

13. A temperature conditioning apparatus, comprising:

a heat exchanger having a first coil slab and a second coil slab, wherein the first coil slab has a first side and a second side and the second coil slab has an upstream side and a downstream side;

a blower forcing air through the first coil slab and the second coil slab; and a damper system adjacent to the heat exchanger and being selectively movable to a normal mode position and an enhanced mode position, wherein the air travels first thru the first coil slab and next thru the second coil slab when the damper is in enhanced position, the air travels from first side to the second side and travels from the upstream side to the downstream side when the damper system is at the normal mode position, and the air travels from the second side to the first side and travels from the upstream side to the downstream side when the damper system is at the enhanced mode position.

14. The temperature conditioning apparatus of claim 13, wherein the air moves at a greater flow rate when the damper system is in the normal mode position than when in the enhanced mode position.

15. The temperature conditioning apparatus of claim 14, wherein the blower operates at a substantially constant speed regardless of whether the damper system is at the normal mode position or the enhanced mode position.

16. The temperature conditioning apparatus of claim 13, wherein the damper system is further movable to a bypass position where the air is free to bypass both the first coil slab and the second coil slab.

17. The temperature conditioning apparatus of claim 13, wherein the heat exchanger provides greater airflow resistance when the damper system is at the enhanced mode position than when at the normal position.

18. The temperature conditioning apparatus of claim 13, wherein the first coil slab and the second coil slab are closer to each other at an upper portion of the heat exchanger than at a lower portion of the heat exchanger.

19. The temperature conditioning apparatus of claim 13, wherein the temperature conditioning apparatus is a heat pump, whereby the heat exchanger selectively heats and cools the air.

20. The temperature conditioning apparatus of claim 13, wherein the heat exchanger heats the air.

21. The temperature conditioning apparatus of claim 13, wherein the heat exchanger cools the air.

22. The temperature conditioning apparatus of claim 21, further comprising a burner disposed beneath the heat exchanger.

23. The temperature conditioning apparatus of claim 13, further comprising a refrigerant that flows in parallel flow relationship through the first coil slab and the second coil slab.

24. An apparatus for conditioning air, comprising:

a heat exchanger having a first coil slab and a second coil slab, wherein the first coil slab has a first side and a second side and the second coil slab has an upstream side and a downstream side, and wherein the first coil slab and the second coil slab are closer to each other at an upper portion of the heat exchanger than at a lower portion of the heat exchanger;

a damper system adjacent to the heat exchanger and being selectively movable to a normal mode position and an enhanced mode position, wherein the air first travels thru the first coil slab and next thru the second coil slab when the damper is in the enhanced mode position, the air travels in parallel flow relationship through the first coil slab and the second coil slab when the damper system is in the normal mode position, and the air travels in series through the first coil slab and the second coil slab when the damper system is in the enhanced mode position; and a blower that forces the air from the first side to the second side and from the upstream side to the downstream side when the damper system is at the normal mode position, and that forces the air from the second side the first side and from the upstream side to the downstream side when the damper system is at the enhanced mode position, wherein the air moves at a greater flow rate when the damper system is in the normal mode position than when in the enhanced mode position even though the blower operates at substantially the same speed in the normal mode and the enhanced mode.

25. The apparatus of claim 24, wherein the damper system is further movable to a bypass position where the air is free to bypass both the first coil slab and the second coil slab.

26. The temperature conditioning apparatus of claim 24, wherein the temperature conditioning apparatus is a heat pump, whereby the heat exchanger selectively heats and cools the air.

27. The temperature conditioning apparatus of claim 24, wherein the heat exchanger heats the air.

28. The temperature conditioning apparatus of claim 24, wherein the heat exchanger cools the air.

29. The temperature conditioning apparatus of claim 28, further comprising a burner disposed beneath the heat exchanger.

30. The temperature conditioning apparatus of claim 24, further comprising a refrigerant that flows in parallel flow relationship through the first coil slab and the second coil slab.

31. A method of controlling air flowing through a heat exchanger that is selectively operable in a normal mode and an enhanced mode, wherein the heat exchanger includes a first coil slab and a second coil slab, the first coil slab has a first side and a second side, and the second coil slab has an upstream side and a downstream side, the method comprising:

conveying air from the first coil slab to the second coil slab when operating in the enhanced mode;

conveying the air from the first side to the second side when operating in the normal mode;

conveying the air from the upstream side to the downstream side when operating in the normal mode;

conveying the air from the second side to the first side when operating in the enhanced mode; and conveying the air from the upstream side to the downstream side when operating in the enhanced mode.

32. The method of claim 31, further comprising conveying the air at a greater flow rate in the normal mode than in the enhanced mode.

33. The method of claim 31, further comprising:

cooling the air with the heat exchanger; and placing a burner beneath the heat exchanger.

* * * * *